US006224187B1

(12) United States Patent
Inten et al.

(10) Patent No.: US 6,224,187 B1
(45) Date of Patent: May 1, 2001

(54) DEVICE FOR POSITIONING AN INK JET PRINT HEAD AND A CLEANING AND SEALING DEVICE

(75) Inventors: Wolfgang Von Inten; Wolfgang Muhl; Ralf Müller, all of Berlin (DE)

(73) Assignee: Francotyp Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/099,473

(22) Filed: Jun. 18, 1998

(30) Foreign Application Priority Data

Jun. 18, 1997 (DE) ..... 197 26 642

(51) Int. Cl.[7] ..... B41J 2/165
(52) U.S. Cl. ..... 347/32
(58) Field of Search ..... 347/32, 30, 29, 347/33

(56) References Cited

U.S. PATENT DOCUMENTS

| | | | | |
|---|---|---|---|---|
| 4,533,927 | | 8/1985 | Iwagami et al. | 347/35 |
| 4,731,639 | * | 3/1988 | Butmann et al. | 355/64 |
| 4,745,414 | * | 5/1988 | Okamura et al. | 347/30 |
| 5,025,386 | * | 6/1991 | Pusic | 347/4 |
| 5,289,767 | * | 3/1994 | Montalto et al. | 101/35 |
| 5,416,507 | * | 5/1995 | Otsuka | 347/32 |
| 5,479,194 | * | 12/1995 | Hirano et al. | 347/22 |
| 5,570,116 | * | 10/1996 | Soga | 347/30 |
| 5,880,747 | * | 3/1999 | Bartenwerfer et al. | 347/4 |

* cited by examiner

*Primary Examiner*—N. Le
*Assistant Examiner*—Anh T. N. Vo
(74) *Attorney, Agent, or Firm*—Herbert L. Lerner; Laurence A. Greenberg; Werner H. Stemer

(57) ABSTRACT

A device for positioning an ink jet print head and a cleaning and sealing device may be used in a postage meter and/or addressing machine for print media guided along a printing window in a guide plate by a transport device. In order to improve printing quality, the print head stationarily disposed behind the guide plate and the printing window is adjustable out of a printing position to be set in a defined way, into a cleaning and/or a sealing position and back again, and a cleaning and sealing device adapted to the print head can be coupled to the print head in a positionally accurate and functionally appropriate manner. The print head is pivotably secured and the cleaning and sealing device is disposed behind the guide plate, but linearly adjustably toward and away from the print head. A common gear for adjustment of the print head and the cleaning and sealing device is driven by a motor running in only one direction of rotation. The print head, the cleaning and sealing device, the gear and the motor are combined into a compact structural group secured adjustably to the transport device.

26 Claims, 11 Drawing Sheets

4221
4232
4231
4221
4231
4232
4
4
4

4142
4141
4122
4123
4124
4126
4311
4231
4221
4414
4121
4125
4311
4321
4221
4211
4132
4131
4112
4111
4
4
4

DEVICE FOR POSITIONING AN INK JET PRINT HEAD AND A CLEANING AND SEALING DEVICE

BACKGROUND OF THE INVENTION

Field of the Invention

The invention relates to a device for positioning an ink jet print head and a cleaning and sealing device, in particular in a postage meter and/or addressing machine.

In postage meters and/or addressing machines that have been on the market until now, printing is primarily carried out by ink rollers or thermal print heads.

Recently, efforts have been directed toward exploiting the advantages of ink jet printing in the field of applying postage and/or addressing mail by machine. The printing is carried out in a contactless manner through the use of ink jet print heads, as is seen in German Patent DE 44 24 771 C1 and German Utility Model DE 94 20 734 U1.

In that connection, a postage meter has been proposed in German Patent DE 196 05 014 C1, corresponding to U.S. Pat. application Ser. No. 08/791,630, filed Jan. 31, 1997, in which letters or envelopes are fed standing upright, tilting slightly to the rear, with the aid of a conveyor belt. The letters or envelopes rest there on a guide plate, in which a printing window is provided and in which the ink jet print head is fixedly installed. The letter or envelope is moved past the printing window or ink jet print head and during that time is imprinted on the side facing away from the observer.

However, the problem of ink jet print head cleaning and sealing is not addressed therein.

In conventional office printers with ink jet print heads, the recording medium and the ink jet print head are moved in alternation toward one another in orthogonal directions, with the spacing between the two being constant. The motion of the ink jet print head is effected as a rule in a forced guide crosswise to the ink ejection direction, or parallel to the plane of the recording medium.

That is also the case when the ink jet print head is cleaned and/or sealed off during certain intervals when no printing is being carried out.

To that end, the ink jet print head is moved, by the same drive mechanism as for printing, into a cleaning and sealing position laterally outside the printing position, and it remains in that position while a cleaning and sealing device is moved toward it and docked, as is seen in U.S. Pat. No. 4,533,927. The motion of the cleaning and sealing device is effected through the use of a lever system, without an additional drive mechanism, by utilizing the print head motion that extends parallel to the plane of the recording medium.

That principle cannot be adopted in the present structure, because of the different guidance of the print medium and because of the ink jet print head which is disposed stationarily for the printing process.

In another known configuration, for which reference is made to German Patent DE 36 08 912 C2, the ink jet print head on one hand is supported on guide rods so as to be translationally displaceable parallel to the plane of the recording media, which corresponds to its working position, and on the other hand is also supported rotatably and eccentrically in a drive housing. Through the use of the drive housing, the ink jet print head can be selectively rotated into a working position, a cleaning position, or a position of repose with sealing, and can be displaced in the ink ejection direction or contrary thereto.

In the cleaning position, priming can be carried out with manual tripping, and the nozzle surface of the ink jet print head can be wiped off through the use of a scraper.

In the position of repose, the nozzle surface of the print head is pressed against a diaphragm cap and sealed off in that way.

Aside from the fact that manual tripping is no longer conventional in modern machines, there is also the risk in the case of accelerated motion that ink will be unintentionally thrown off by centrifugal force, or that in the contrary direction of motion the ink jet print head will aspirate air, causing the ink meniscus to detach.

Finally, a device for cleaning an ink jet print head is also known from International Patent Application WO 96/15908 A1, in which the ink jet print head is secured so as to be pivotable out of a printing position into a cleaning position and/or sealing position and back again. A cleaning and sealing device is also disposed behind the guide plate but in such a way that it is linearly adjustable toward and away from the ink jet print head.

The cleaning and sealing device includes a sealing cap adapted to the ink jet print head, with suction slits for each row of nozzles, and it also includes a transversely adjustable wiper lip and a downstream suction pump. In the sealing cap, a vacuuming region is also provided on one end, with a central suction opening for the wiper lip. The wiper lip is adjusted through the use of a spindle drive.

The goal of the invention is to improve the print quality.

SUMMARY OF THE INVENTION

It is accordingly an object of the invention to provide a device for positioning both an ink jet print head and a cleaning and sealing device, which overcomes the hereinafore-mentioned disadvantages of the heretofore-known devices of this general type, with which an ink jet print head disposed in a stationary manner behind a guide plate can be adjusted out of a printing position that can be established in a defined way, into a cleaning position and/or into a sealing position and back again, and with which a cleaning and sealing device adapted to the ink jet print head and provided with a wiper lip can be coupled for proper function and in a precise position with the ink jet print head.

With the foregoing and other objects in view there is provided, in accordance with the invention, in an apparatus, in particular a postage meter and/or an addressing machine, having a guide plate with a printing window, an ink jet print head disposed stationarily behind the guide plate in the printing window during printing, a cleaning and sealing device, and a transport device for guiding print media resting on the guide plate, a device for positioning the ink jet print head and the cleaning and sealing device, comprising a common gear for pivoting the ink jet print head out of a printing position, into a cleaning position and/or sealing position and back again, and the common gear for adjusting the cleaning and sealing device behind the guide plate toward and away from the ink jet print head; and a motor running in only one direction of rotation for driving the common gear to adjust the ink jet print head and the cleaning and sealing device.

In accordance with another feature of the invention, there is provided a common frame, the ink jet print head, the cleaning and sealing device, the common gear and the motor secured in the common frame and combined into a compact structural group adjustably secured to the transport device.

In accordance with a further feature of the invention, the guide plate is inclined past the vertical; the ink jet print head is pivotable by more than 90° out of the printing position, into the cleaning position and back again; and the cleaning and sealing device is disposed in a linearly height-adjustable manner below the ink jet print head.

In accordance with an added feature of the invention, there is provided a shaft rotatably supported in the frame, the ink jet print head secured to the shaft; and a carrier for the transport device, the frame pivotably secured within an adjusting range on the carrier.

In accordance with an additional feature of the invention, there is provided a rigid support shaft and a rotationally movable, resiliently adjustable adjusting element disposed on the frame; the support shaft and the adjusting element connecting the frame to the carrier; the support shaft thrust into a bore in the carrier and resiliently locked; and the adjusting element rotatable about the support shaft within a tolerance range.

In accordance with yet another feature of the invention, the cleaning and sealing device includes a sealing cap, a wiper lip, a suction pump, a waste ink tank, a frame for fastening to the common frame, and two vertically disposed columns secured in the frame; and the sealing cap, the wiper lip and the suction pump are guided adjustably in height between the two vertically disposed columns.

In accordance with yet a further feature of the invention, there is provided an adjustable stop, the ink jet print head supported rotatably and resiliently against the adjustable stop; and the sealing cap supported resiliently and floatingly.

In accordance with yet an added feature of the invention, there are provided guide shafts secured to the outside of and parallel to the sealing cap, the wiper lip linearly adjustably supported on the guide shafts.

In accordance with yet an additional feature of the invention, the wiper lip has a housing, and a spindle drive for adjusting the wiper lip includes a threaded bush inserted into the wiper lip housing; a motor; a spur gear driven by the motor; and a threaded rod rotatably secured to the sealing cap adjacent and parallel to one of the guide shafts, the threaded rod having one side coupled to the spur gear and another side on which the threaded bush is seated.

In accordance with again another feature of the invention, the gear for adjusting the ink jet print head and the cleaning and sealing device is constructed substantially as a Maltese cross gear including a spur gear coupled directly to the motor; one double-jointed connection from the spur gear to the ink jet print head 2; another double-jointed connection from the spur gear to the cleaning and sealing device; an evaluation and control circuit; two photosensors connected to the evaluation and control circuit; and a slotted disk coupled with the gear for scanning the two photosensors.

In accordance with again a further feature of the invention, the motor has a shaft with an extension; the double-jointed connections have first cranks; and the spur gear includes a worm seated on the extension; first and second shafts; a worm wheel and a small gear wheel jointly seated on the first shaft, with the worm wheel meshing with the worm; a large gear wheel seated on the second shaft and meshing with the small gear wheel; first and second cam disks having the same profile and a slightly different diameter, and a toothed quadrant wheel having the same outer diameter as the second cam disk and aligned with the first and second cam disks on the second shaft downstream of the large gear wheel; a flange disk for the slotted disk, the flange disk and the slotted disk seated on the second shaft; third and fourth shafts; one first and one second pinion and the first crank of the one double- jointed connection to the ink jet print head jointly seated on the third shaft, the first pinion meshing with the first cam disk, and the second pinion meshing with the second cam disk and the toothed quadrant wheel, in a play-free connection; and another first and another second pinion and the first crank of the other double-jointed connection to the cleaning and sealing device jointly seated on the fourth shaft, the first pinion meshing with the first cam disk, and the second pinion meshing with the second cam disk and the toothed quadrant wheel, in a play-free connection.

In accordance with again an added feature of the invention, the one double-jointed connection of the spur gear to the ink jet print head includes the first crank having one end rigidly joined to the third shaft and another end, a first articulated shaft rotationally movably joined to the other end of the first crank, a rod having one end rotationally movably seated on the first articulated shaft and another end, a second articulated shaft rotationally movably connected to the other end of the rod, and a second crank having one end rigidly connected to the second articulated shaft.

In accordance with again an additional feature of the invention, the other double-jointed connection of the spur gear to the cleaning and sealing device includes the first crank having one end rigidly joined to the fourth shaft and another end, a first articulated shaft rotationally movably joined to the other end of the first crank, a rod having one end rotationally movably seated on the first articulated shaft and another end, a second articulated shaft rotationally movably connected to the other end of the rod, and a second crank having one end rigidly connected to the second articulated shaft.

In accordance with still another feature of the invention, there is provided another shaft rotatably supported in the frame, the ink jet print head secured to the other shaft; the second crank having another end rotationally movably secured to the other shaft and having a fixed stop and an adjustable stop; the ink jet print head resiliently pivotable between the stops, the ink jet print head resting force-lockingly on the adjustable stop; and the stops having a spacing defining the play for the ink jet print head.

In accordance with still a further feature of the invention, there is provided a spiral spring thrust onto the other shaft and having one end catching on the frame and another end catching on a housing of the ink jet print head; and the adjustable stop being an adjusting screw guided in a threaded hole in the second crank.

In accordance with still an added feature of the invention, the second crank is a sled to be displaced under compulsory guidance on the columns.

In accordance with still an additional feature of the invention, the double-jointed connections are coupled diametrically opposite one another to the spur gear.

In accordance with another feature of the invention, the slotted disk has an outer periphery with slots corresponding to a number of positions or position combinations of the ink jet print head and the cleaning and sealing device; and a kinematic conversion of all of the positions and attendant functions is distributed over one full revolution of the slotted disk.

In accordance with a further feature of the invention, the ink jet print head has a nozzle surface; the slots are first through sixth slots and the positions include: a sealing position associated with the first slot, in the sealing position the ink jet print head is pivoted with the nozzle surface parallel to the front side of the sealing cap, the sealing cap is docked at the ink jet print head, and the wiper lip has moved into a lateral maintenance position; a wiping position associated with the second slot, in the wiping position the sealing cap has moved downward so far that the wiper lip can slide unhindered over the nozzle surface; a first position of repose associated with the third slot, in the first position of repose the sealing cap has moved downward as far as its bottom dead center position, and the ink jet print head is disposed with its nozzle surface still unchanged, parallel to the front side of the sealing cap; a printing position associated with the fourth slot, in the printing position the ink jet print head is disposed with its nozzle surface parallel to the guide plate, and the sealing cap is still down as far as bottom dead center; a second position of repose associated with the fifth slot, in the second position of repose the ink jet print head is pivoted out of the printing position into the position of repose, and the sealing cap is still disposed at bottom dead center; and a readiness position associated with the sixth slot, in the readiness position the ink jet print head assumes the position of repose and the sealing cap, arriving at an accelerated pace from bottom dead center, comes to rest slightly below the wiping position.

In accordance with an added feature of the invention, the first slot for the sealing position is wide enough to trip both parallel photosensors simultaneously, and the second through sixth slots are only wide enough to trip one photosensor at a time.

In accordance with an additional feature of the invention, the large gear wheel has uniform toothing throughout; the two cam disks have an outer periphery each with first and second slots inside a semicircle and a remainder constructed as a blocking circle; the toothed quadrant wheel includes regions associated with the slots having first and second sets of teeth with roots at a given depth, and a remainder cut out smoothly in a round circle to the given depth; and in clockwise direction following the blocking circle: the first slot of the cam disks and the first set of teeth of the toothed quadrant wheel mesh with the first and second pinions of the one double-jointed connection with the ink jet print head to achieve the printing position; the second slot of the cam disks and the second set of teeth of the toothed quadrant wheel mesh with the first and second pinions of the one double-jointed connection with the ink jet print head to achieve the second position of repose; the first slot of the cam disks and the first set of teeth of the toothed quadrant wheel mesh with the first and second pinions of the other double-jointed connection with the cleaning and sealing device to achieve the sealing position; and the second slot of the cam disks and the second set of teeth of the toothed quadrant wheel mesh with the first and second pinions of the other double-jointed connection with the cleaning and sealing device to achieve the first position of repose.

In accordance with yet another feature of the invention, the first pinion has uniform toothing including four undercut teeth and is narrower than the associated first cam disk, and the slots of the cam disk are dimensioned to permit two teeth at a time to plunge into them simultaneously; the second pinion is dimensioned thick enough to attain nearly a total dimension including both a thickness of the second cam disk and a thickness of the toothed quadrant wheel; a portion of the second pinion meshing with the second cam disk has two diametrically opposed tooth gaps, with otherwise uniform toothing, and the slots in the second cam disk are dimensioned to permit two teeth at a time to plunge into them simultaneously; and the toothed quadrant wheel has regions associated with the slots with toothing equivalent to half a revolution of the second pinion.

In accordance with yet a further feature of the invention, the ink jet print head has nozzle rows; the sealing cap has rubber-elastic flanges for vacuuming the nozzle rows, ventilation holes in the flanges, and a hose connection from the ventilation holes; and a valve is connected to the hose connection.

In accordance with yet an added feature of the invention, the valve has a slightly protruding rubber-elastic opening and is disposed in a path of motion of one of the sides of the first crank of the other double-joint connection of the gear to the cleaning and sealing device for closing the rubber-elastic opening with the side in the sealing position but opening the rubber-elastic opening again before leaving the sealing position.

In accordance with a concomitant feature of the invention, the valve is secured to the common frame.

Securing the ink jet print head and the cleaning and sealing device as well as the drive mechanism for both of them in a common frame surprisingly makes some problems that are otherwise hard to solve, easy to solve.

The cleaning and sealing device is necessarily carried along in the main adjustment of the ink jet print head, so that separate readjusting operations are dispensed with in this case. Other adaptation problems that may still be possible between the ink jet print head and the cleaning and sealing device are easily compensated for by the resilient bearing of the ink jet print head and the floating bearing of the cleaning and sealing device.

The use of a common gear is not only thrifty but also simplifies the kinematic adaptation in an astonishing way.

Other features which are considered as characteristic for the invention are set forth in the appended claims.

Although the invention is illustrated and described herein as embodied in a device for positioning both an ink jet print head and a cleaning and sealing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 2*a*, 2*b* and 2*c* are enlarged views showing details of a fastening, drive and adjustment of the ink jet print head, in which FIG. 2*a* is a front-perspective view of a frame with the ink jet print head, FIG. 2*b* is a perspective view of a crank for an ink jet print head drive mechanism, and FIG. 2*c* is a side-elevational view of FIG. 2*b;*

FIGS. 3 and 3*a* are respective perspective and elevational views showing details for securing a common frame for an ink jet print head and a cleaning and sealing device, along with accessory equipment in a transport mechanism;

DESCRIPTION OF THE PREFERRED EMBODIMENTS

Figure 1:
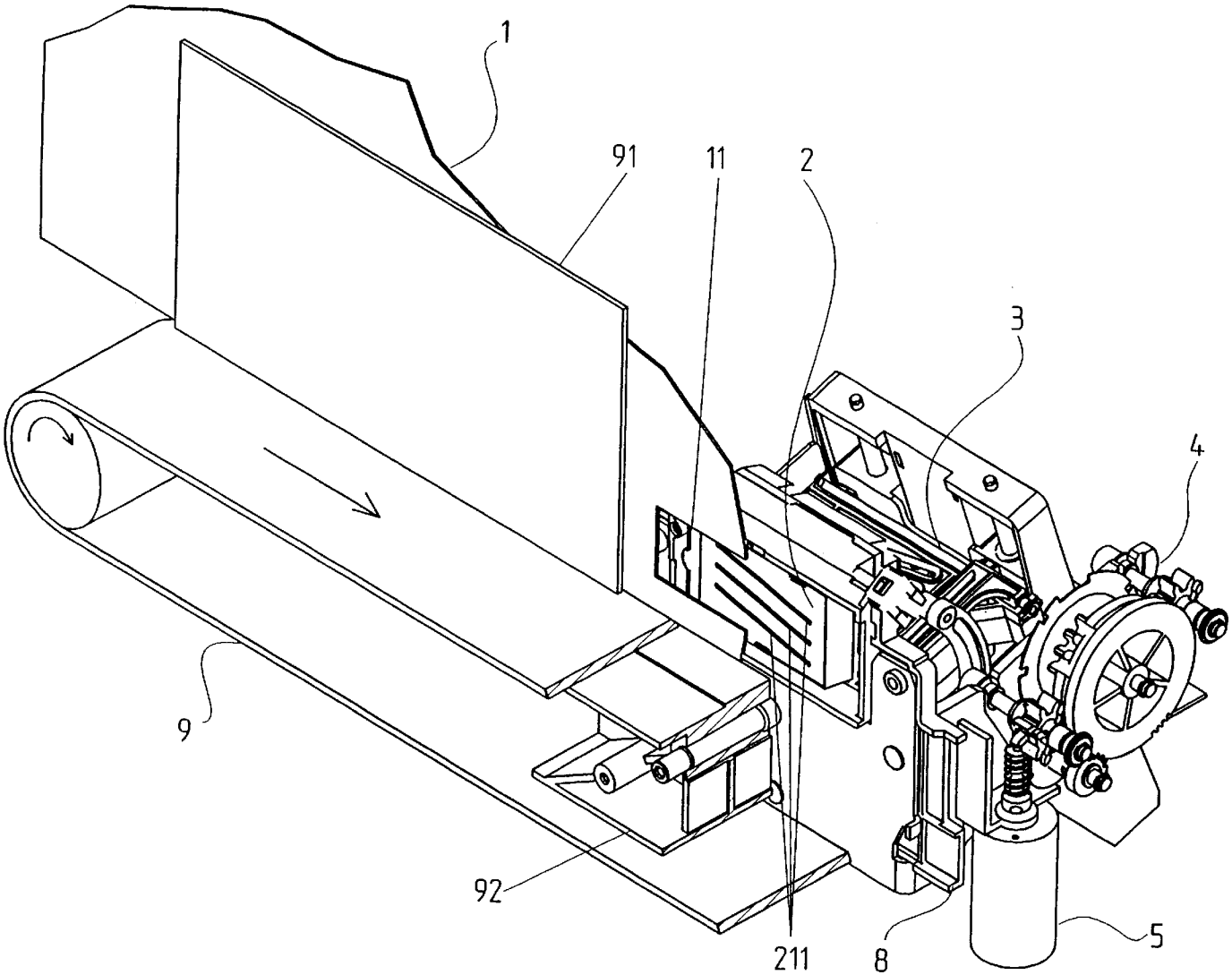
FIG. 1 is a diagrammatic, partly-broken away perspective view of a postage meter with a configuration according to the invention.

Referring now in detail to the figures of the drawings, which are partly diagrammatic for the sake of simplicity and ease of comprehension, and first, particularly, to FIG. 1 thereof, there is seen a postage meter which has a guide plate 1 with a printing window 11, an ink jet print head 2 referred to below as IPH, which is stationarily disposed in the printing window 11, a transport device 9 for print media 91, and a cleaning and sealing device 3, referred to below as CSD, for the ink jet print head 2.

In order to establish various functional positions, a common gear 4 is provided for both the IPH 2 and the CSD 3. The common gear 4 is driven by a motor 5 that runs in only one rotational direction.

The IPH 2 and the CSD 3 are disposed on the same side of the guide plate 1, with the CSD 3 below the IPH 2.

The IPH 2, the CSD 3 and the common gear 4 along with the motor 5 are secured within a common frame 8 and in this way are combined into a compact structural group. The frame 8 in turn is adjustably secured to a carrier 92 of the transport device 9. This presents a possibility for calibration, in order to achieve parallelism between a transport direction and printed lines.

The guide plate 1 is inclined past the vertical, and the IPH 2 can be pivoted by more than 90° upward and back again, out of a printing position to a cleaning position and back again.

The CSD 3 is disposed below the IPH 2 in such a manner that it is adjustable in height.

Figure 5:
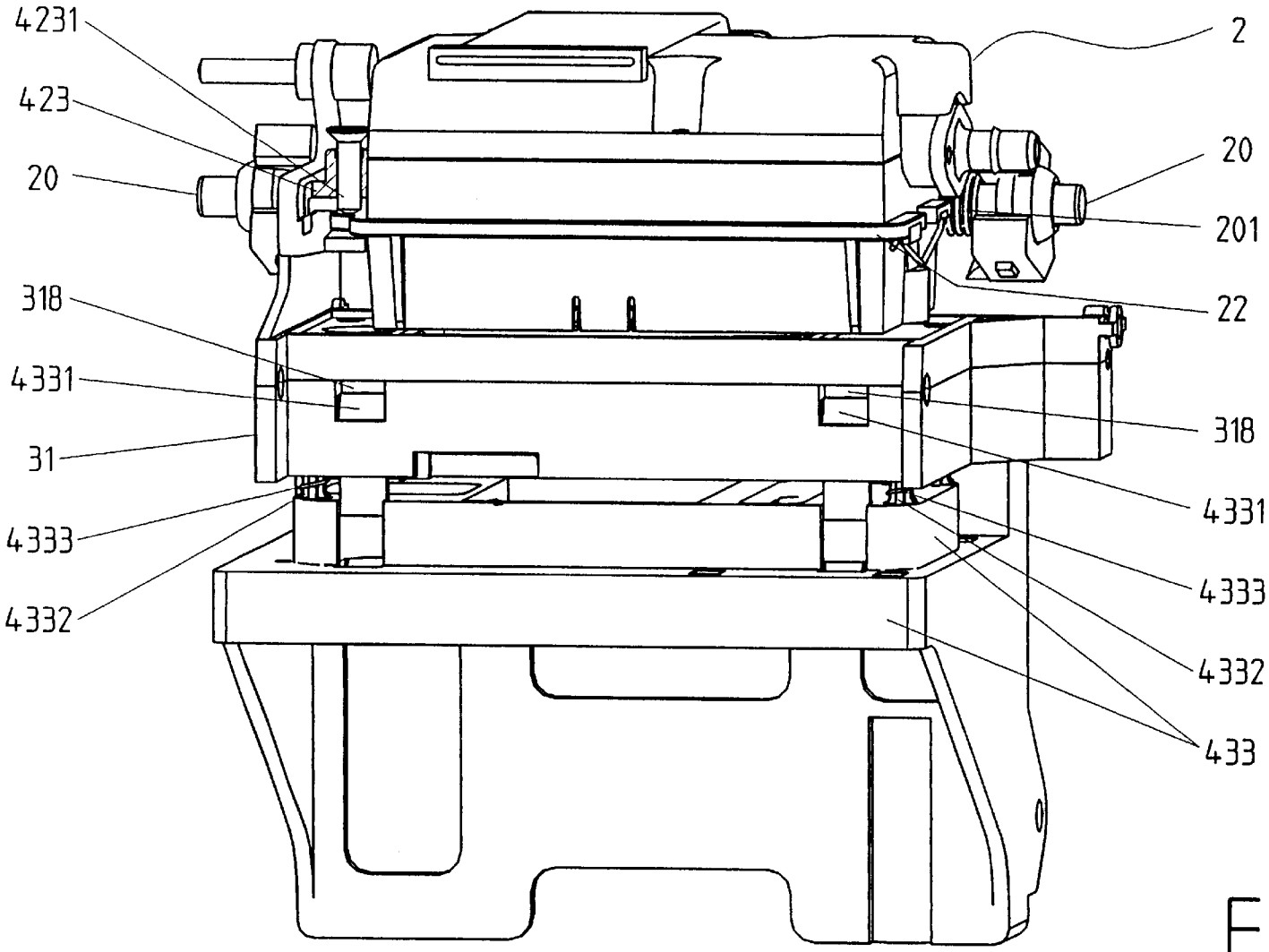
FIG. 5 is a perspective view showing details of the ink jet print head with a sealing cap docked and with a drive crank.

According to FIGS. 2*a*, 2*b* and 2*c*, the IPH 2 is secured on a shaft 20 with little play Δ against a spring 201. The play is dimensioned in such a way that calibration for parallelism between a nozzle surface 2101 of the IPH 2 and the guide plate 1 for the sake of a correct printing position is possible. Reference is also made to FIGS. 1 and 5 in this regard. As a result, there is also additional tolerance compensation upon coupling of the CSD 3 to the IPH 2.

The shaft 20 is rotatably supported in the frame 8.

The IPH 2 is coupled laterally to the gear 4 through a crank 423, which is also seated on the shaft 20 and is seen in FIGS. 2*b* and 2*c*. The IPH 2 is pivoted from the printing position to the sealing position and back again through the use of the crank 423.

Figure 3:
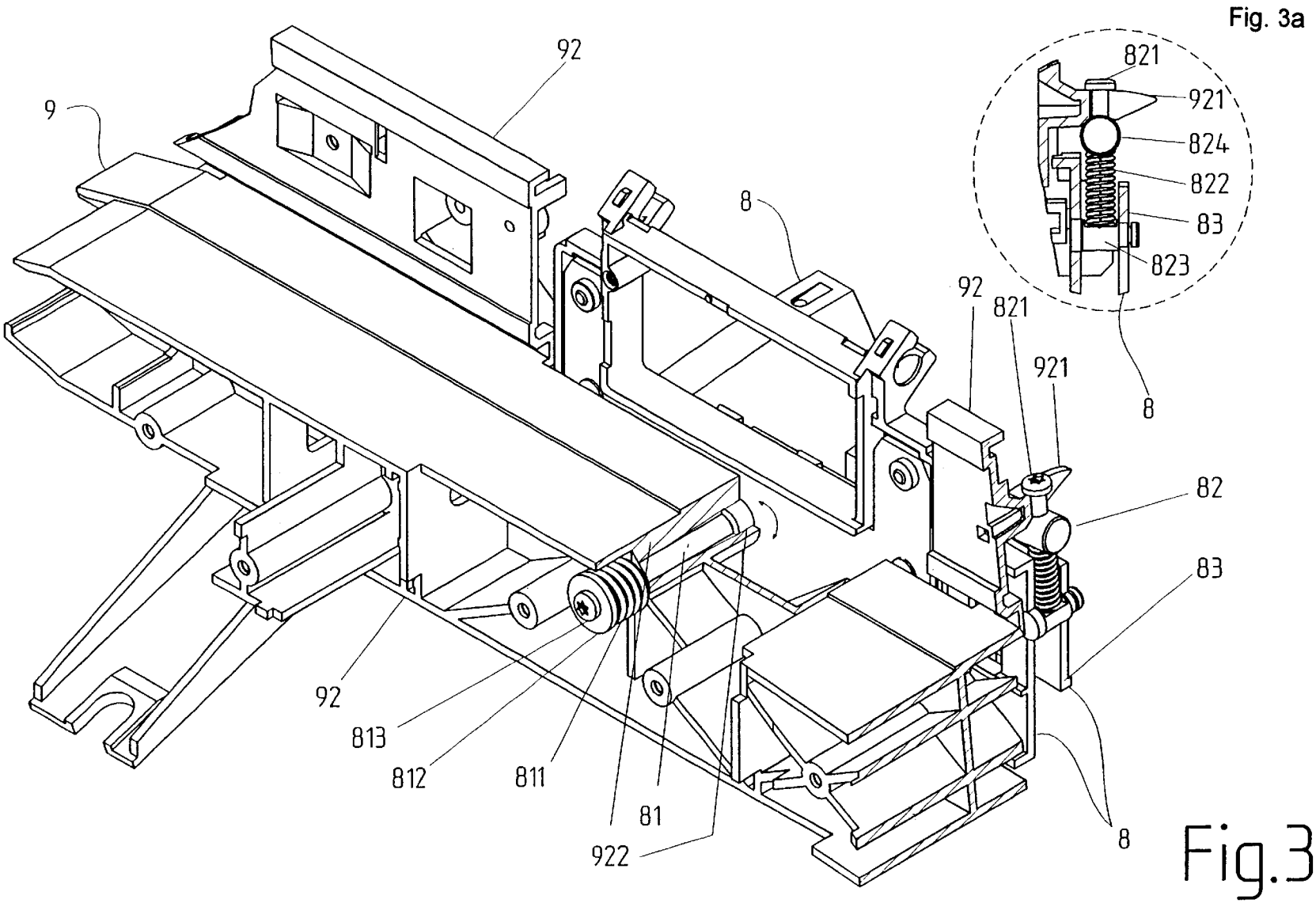

According to FIGS. 3 and 3*a*, a rigid support shaft 81 protrudes from a front side of the common frame 8 and is secured to the frame 8 at the carrier 92 of the transport device 9.

The support shaft 81 is inserted through a corresponding bore 922, which is constructed in such a way that it both serves to secure the support shaft 81 and acts as a slide bearing therefor. The support shaft 81 is secured in the carrier 92 and the bore 922 through the use of a screw 813, a washer 812 and a compression spring 811, in such a way that the frame 8 can be rotated within an adjustment range. The compression spring 811 is fastened between the washer 812 and the carrier 92.

For the sake of adjusting the frame 8, the frame has an adjusting element 82, which on one hand is rotationally movably secured to the frame 8 and on the other hand is longitudinally adjustably secured to the carrier 92. As is seen in FIG. 3*a*, the adjusting element 82 includes an adjusting screw 821, a compression spring 822 slipped onto the adjusting screw 821, a bearing piece 823 and a locking piece 824.

The bearing piece 823 is rotationally movably slipped into adapted bores of the front wall and of a support wall 83 which is part of the frame 8 and is parallel to the front wall, and the bearing piece is locked in place. The bearing piece 823 is provided with a threaded hole for the adjusting screw 821. Before assembly, the locking piece 824 rests on the head of the adjusting screw 821 as a consequence of the action of the compression spring 822, which is supported at its other end on the bearing piece 823. Two wedge-shaped tabs 921 are disposed on the carrier 92, and the adjusting element 82 is thrust between them. This is done in such a way that the head of the adjusting screw 821 is supported at the top on the tabs 921, and the locking piece 824 is locked in a force-locking manner below into adapted recesses of the tabs 921. A force-locking connection is one which connects two elements together by force external to the elements, as opposed to a form-locking connection which is provided by the shapes of the elements themselves.

The frame 8 is either raised or lowered by rotation of the adjusting screw 821, depending on the direction of rotation. In this way, such an accurate adjustment of the IPH 2 becomes possible that gaps or overlaps in a printed image are avoided.

Figure 4:
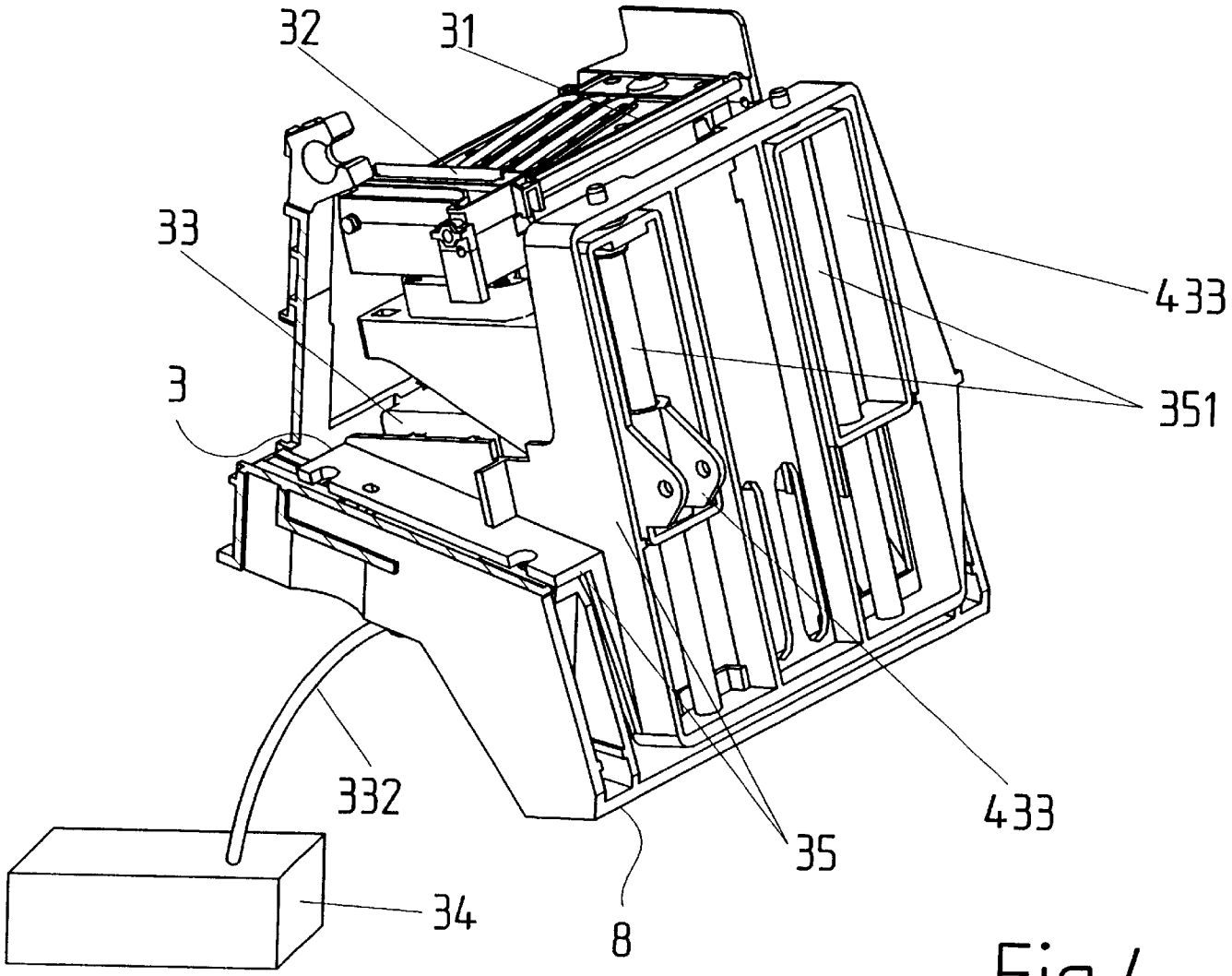
FIG. 4 is a perspective view showing details of the cleaning and sealing device.
Figure 6:
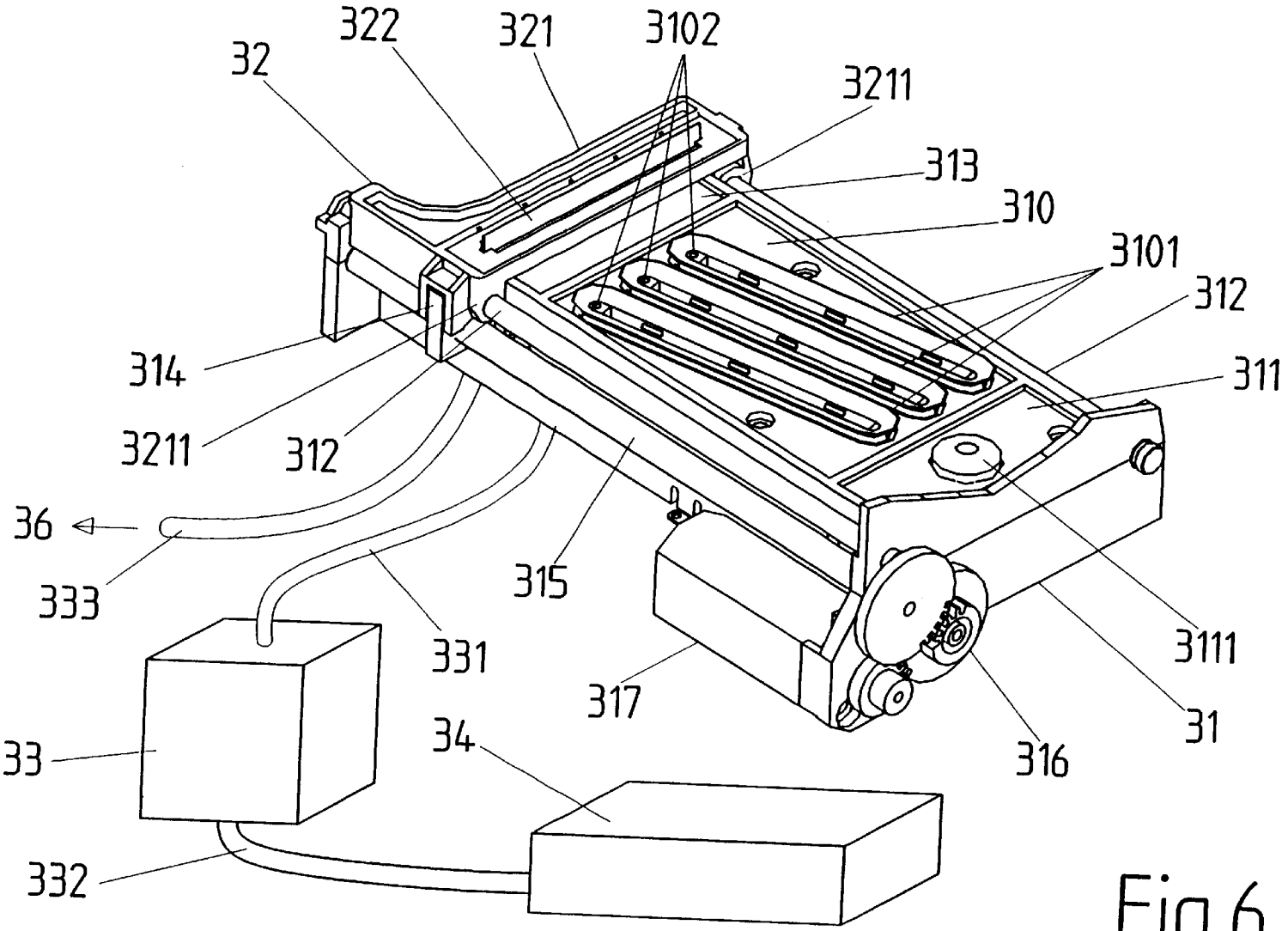
FIG. 6 is a perspective view showing details of the sealing cap with a wiper lip drive mechanism.

According to FIG. 4 and FIG. 6, the CSD 3 along with a gear for a wiper lip 32 and an associated motor 317 are secured in a frame 35, which in turn is secured in the frame 8.

The CSD 3 has a sealing cap 31, which is adjustable in height inside the frame 35, along with the wiper lip 32. The CSD 3 also has a suction pump 33 which is coupled both mechanically and fluidically with the sealing cap 31.

As is seen in FIG. 6, on one hand, a flexible hose connection 331 is connected from the suction pump 33 to the sealing cap 31 in a non-illustrated manner and on the other hand, a flexible hose connection 332 is connected to a waste ink tank 34.

Two parallel columns 351 are inserted in a rear portion of the frame 35. The sealing cap 31 is guided long the columns 351 in an adjustable-height manner through a sledlike crank 433 of a double-jointed connection 43 of the gear 4 shown in FIGS. 4 and 7. The sealing cap 31 and the suction pump 33 are detachably secured through the use of partly visible suitable snap connections 318, 4331, to the crank 433, which is correspondingly constructed in a lectern-like form, as is seen in FIG. 5.

An IPH 2 with the sealing cap 31 docked to it is seen from behind in FIG. 5. The sealing cap 31 is supported on the lectern-like part of the crank 433 on compression springs 4333. The compression springs 4333 are slipped onto stops or protrusions 4332 that act as guide protrusions for the sealing cap 31. The sealing cap 31 is provided with the snap connections or recesses 318, into which hooks 4331 of the crank 433 have snapped. In this way, on one hand secure locking of the sealing cap 31 to the crank 433 and on the other hand a floating support of the sealing cap 31, are attained. Due to the floating support, the accurate-position coupling of the sealing cap 31 to the IPH 2 is possible without difficulties, and overloads are avoided.

The compensation play for the IPH 2 is determined on one hand, as already noted, by the two stops or protrusions 4231 and 4232 in the crank 423. Due to the action of the spring 201, a housing 22 of the IPH 2 rests in a force-locking manner on the adjustable stop 4231.

Figure 2:
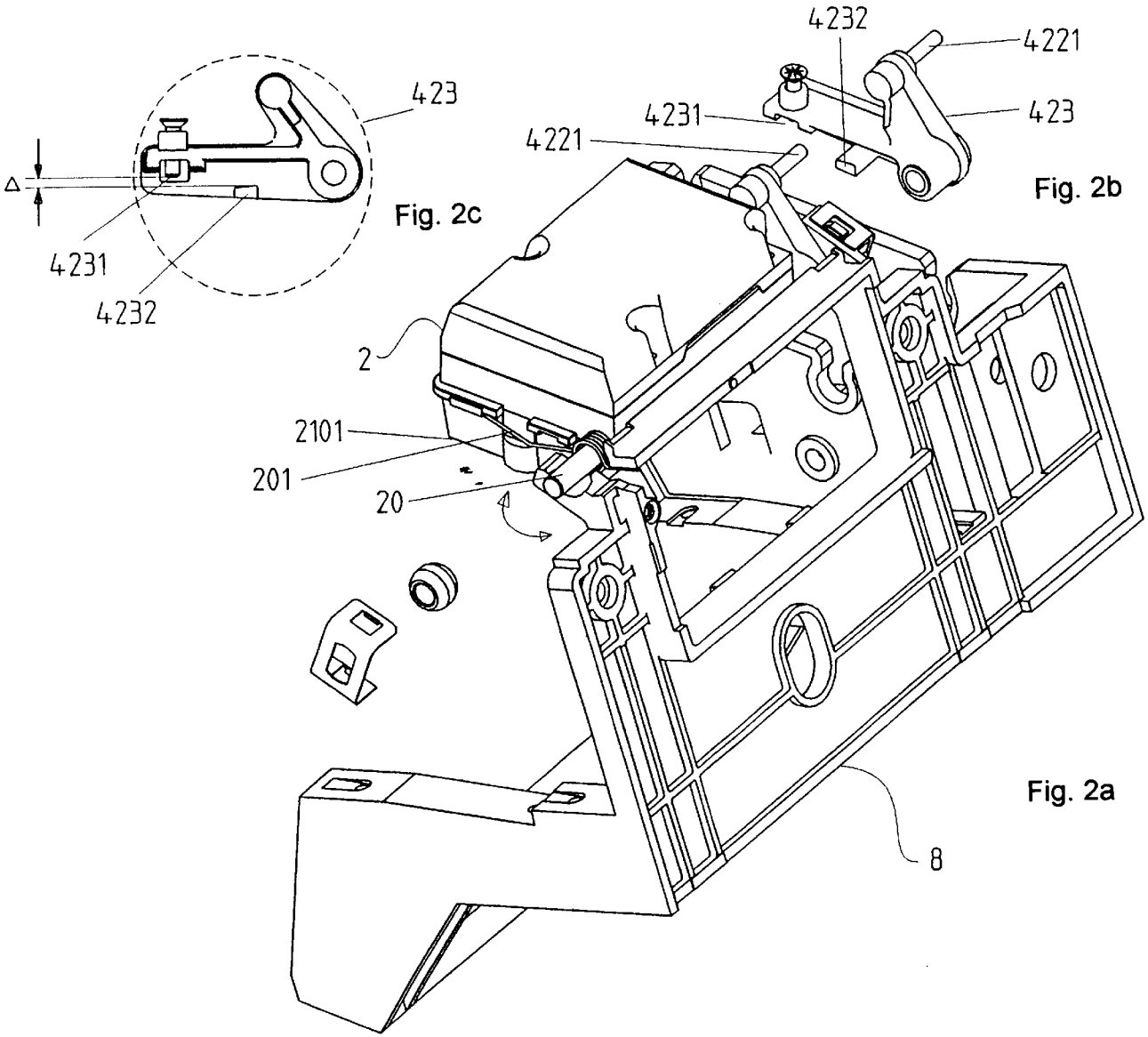

The spring 201 is thrust onto the shaft 20 and rests with one end on the housing 22 and another end on the frame 8, as is also seen in FIG. 2.

According to FIG. 6, the sealing cap 31 is divided into three functional regions:

a suction region 310 for nozzle rows 211 of the IPH 2, as is also seen in FIG. 1;

a suction region 311 for the wiper lip 32; and a maintenance region 313 for the wiper lip 32.

Correspondingly, three rubber-elastic trough-like flanges 3101 are inserted into the suction region 310 for the three nozzle rows 211. These flanges are adapted to the geometry of the nozzle rows 211 and are connected through the sealing cap housing to the hose connection 331 leading to the suction pump 33.

Figure 11:
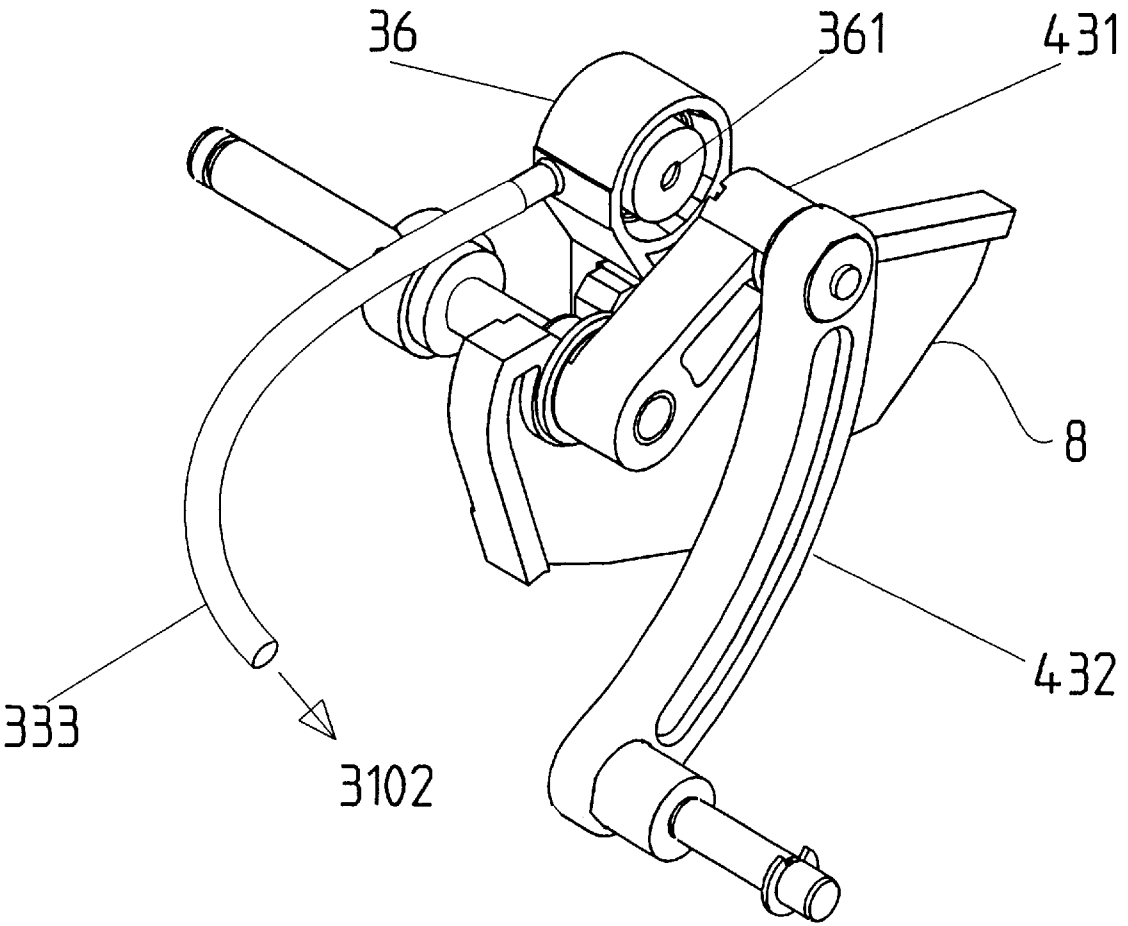
FIG. 11 is a perspective view showing details of a sealing cap ventilation.

In addition, ventilation holes 3102 are provided for each flange 3101. The ventilation holes 3102 discharge through non-illustrated hoses in a common connecting piece, from which a hose 333 leads to a valve 36 for ventilating the sealing cap 31 or the flanges 3101. The valve 36 is actuated by the gear 4 or the first crank 431 of the double-jointed connection 43 with the CSD 3, as is also seen in FIG. 11.

The valve 36 is always opened before the sealing cap 31 is moved away from the IPH 2. In this way, any negative pressure still prevailing in the sealing cap 31 is prevented from aspirating ink out of the nozzles and consequently detaching the ink meniscus in the nozzle channel.

A rubber-elastic, round flange 3111 is inserted centrally in the suction region 311 for the wiper lip 32. The flange 3111 is likewise connected through the sealing cap housing to the hose connection 331 leading to the suction pump 33. When the wiper lip 32 is positioned in the suction region 311, residual ink can be vacuumed or suctioned therefrom.

Specifically, the wiper lip 32 includes a housing 321 and a rubber-elastic doctor blade insert 322. This doctor blade insert 322 is functionally the actual wiper lip.

The wiper lip 32 is located in the maintenance region 313, as is shown in the figure. This position must absolutely be assumed, to avoid damage, when the sealing cap 31 is docked to the IPH 2 or is to be docked thereto.

Two guide shafts 312 are secured on both sides, on the outside and parallel, to the long sides of the sealing cap 31. The wiper lip 32 is linearly adjustably secured with its housing 321 on the guide shafts 312. To that end, the housing 321 is provided with bushes 3211, which are adapted to the guide shafts 312.

In order to adjust the wiper lip 32, a spindle drive is provided, which is composed individually of the following:

a threaded bush 314, which is inserted in the housing 321; and a threaded rod 315, which is secured rotatably to the sealing cap 31 adjacent and parallel to one of the guide shafts 312. The threaded rod 315 is coupled on one side to a spur gear 316 that is driven by the associated motor 317, while the threaded bush 314 is seated on the other side of the threaded rod 315.

Figure 7:
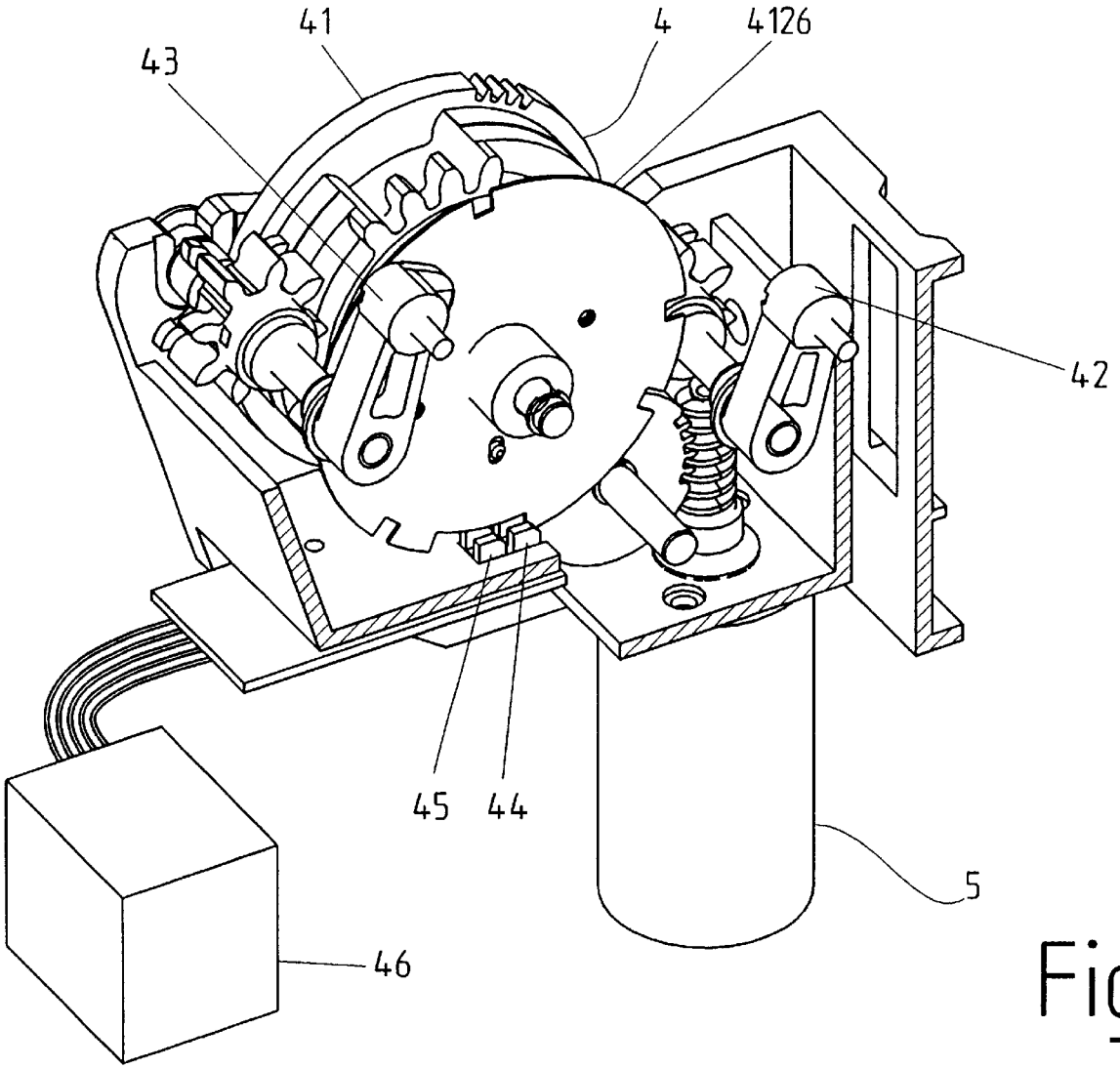
FIG. 7 is a fragmentary, perspective view of a gear.

According to FIG. 7, the gear 4 for adjusting the IPH 2 and the CSD 3 is constructed essentially in the form of a Maltese cross gear.

In detail, the gear 4 is composed of the following:

a spur gear 41, which is coupled directly to the motor 5 for the drive;

a double-jointed connection 42 from the spur gear 41 to the IPH 2; and the double-jointed connection 43 from the spur gear 41 to the CSD 3.

The gear 4 is also coupled with a slotted disk 4126. Two photosensors 44, 45 which are provided for scanning the slotted disk 4126, are connected in turn to an evaluation and control circuit 46. The motor 5 receives current pulses depending on the position of the slotted disk 4126 and on a programmed control regimen. The double-jointed connections 42, 43 are coupled to the spur gear 41 diametrically opposite one another.

Figure 8:
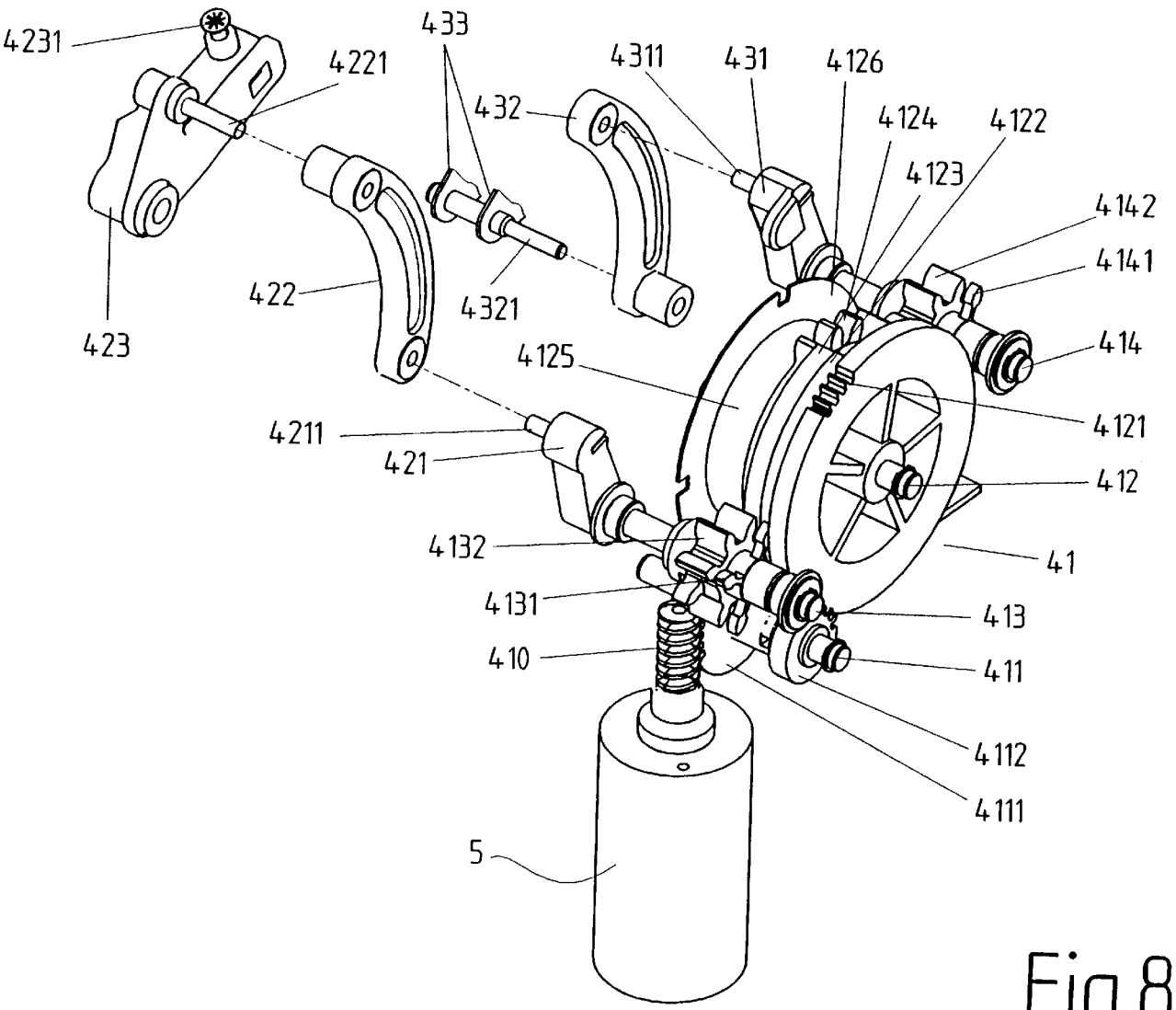
FIG. 8 is a partly exploded perspective view showing details of the gear, in particular a double-jointed connection of a spur gear with the ink jet print head.

As is shown in FIG. 8, the spur gear 41 is composed individually of the following:

a worm 410, which is seated on a shaft of the motor 5 in an extension thereof;

a worm wheel 4111 and a small gear wheel 4112, which are jointly seated on a first shaft 411, with the worm wheel 4111 meshing with the worm 410;

a large gear wheel 4121, which is seated on a second shaft 412, meshes with the small gear wheel 4112, and is a shifting wheel of the spur gear 41;

a first cam disk 4122 and a second cam disk 4123, with the same profile but a diameter differing slightly by approximately 0.1 to 0.2 mm, and a toothed quadrant wheel 4124 with the same outer diameter as the second cam disk 4123, all of these elements being seated downstream of the large gear wheel 4121 on the second shaft 412;

a flange disk 4125 for the slotted disk 4126, both of which are also seated on the second shaft 412;

a first pinion 4131 and a second pinion 4132, which are seated on a third shaft 413 jointly with a first crank 421 of the double-jointed connection 42 leading to the IPH 2, the first pinion 4131 meshing with the first cam disk 4122, and the second pinion 4132 meshing with the second cam disk 4123 and the toothed quadrant wheel 4124, so that a play-free connection is thereby effected; and a first pinion 4141 and a second pinion 4142, which are seated on a fourth shaft 414 jointly with a first crank 431 of the double-jointed connection 43 leading to the CSD 3, the first pinion 4141 meshing with the first cam disk 4122, and the second pinion 4142 meshing with the second cam disk 4123 and the toothed quadrant wheel 4124, so that a play-free connection is thereby effected.

The double-jointed connection 42 of the spur gear 41 to the IPH 2 includes the following:

the first crank 421;

a first articulated shaft 4211;

a rod 422;

a second articulated shaft 4221; and a second crank 423.

The first crank 421 is rigidly joined at one end to the third shaft 413 of the spur gear 41 and at the other end it is rigidly joined to the first articulated shaft 4211.

The rod 422 is rotationally movably seated at one end on the first articulated shaft 4211 and at the other end it is rotationally movably seated on the second articulated shaft 4221.

The second crank 423 is rigidly connected at one end to the second articulated shaft 4221 and it is rotationally movably connected at its other end to the shaft 20 on the IPH 2. The second crank 423 is also coupled to the housing 22 of the IPH 2 through its two stops 4231 and 4232, as already described above and as seen in FIG. 2.

The double-jointed connection 43 of the spur gear 41 to the CSD 3 includes the following:

the first crank 431;

a first articulated shaft 4311;

a rod 432;

a second articulated shaft 4321; and a second crank 433.

The first crank 431 is rigidly joined at one end to the fourth shaft 414 of the spur gear 41 and at the other end it is rigidly joined to the first articulated shaft 4311.

The rod 432 is rotationally movably seated at one end on the first articulated shaft 4311 and at the other end it is rotationally movably seated on the second articulated shaft 4321.

The second crank 433 is rigidly coupled at one end to the second articulated shaft 4321 and it is linearly displaceably coupled with the columns 351, which are inserted into the frame 35 for the CSD 3, as is also seen in FIG. 4.

For the sake of guidance on the two columns 351, the second crank 433 is constructed in the form of a sled and has a lectern-like attachment, to which the sealing cap 31 along with the wiper lip 32 are secured and on which the suction pump 33 is also secured, as is again seen in FIG. 4.

Figure 9:
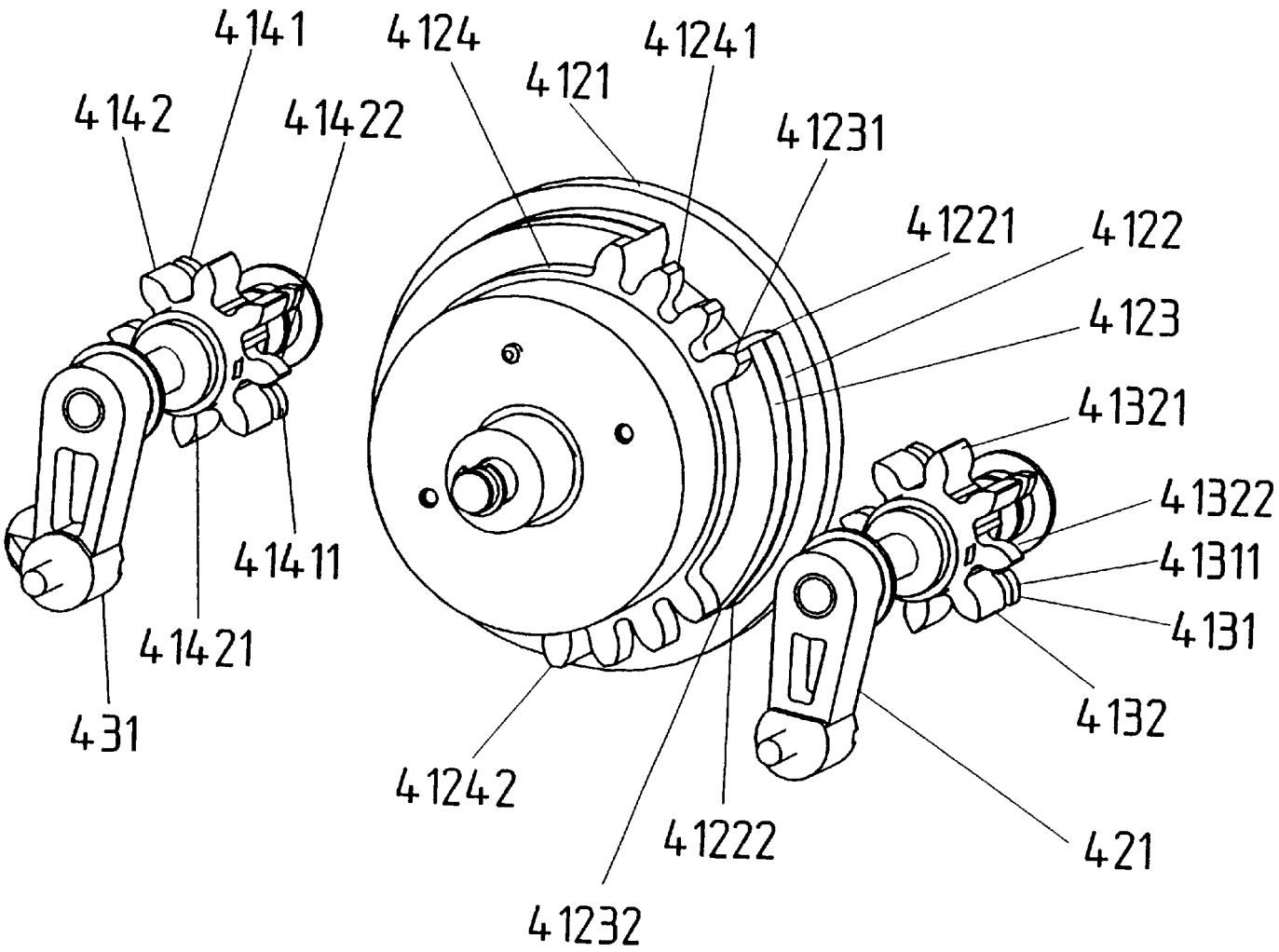
FIG. 9 is a partly exploded perspective view showing details of the gear, in particular the spur gear.

As is shown in FIG. 9, the large gear wheel 4121 has uniform toothing throughout, in accordance with its function as a shifting wheel.

The two cam disks 4122, 4123 are provided on the outside, inside a semicircle, with first and second slots 41221, 41222, 41231, 41232, while the remainder is constructed as a blocking circle.

The toothed quadrant wheel 4124 is provided with first and second sets of teeth 41241, 41242 in regions that are associated with or adjacent the slots 41221, 41222, 41231, 41232 of the cam disks 4122, 4123, while the remainder is cut out smoothly in a round circle to the depth of the root of the teeth.

Figure 10:
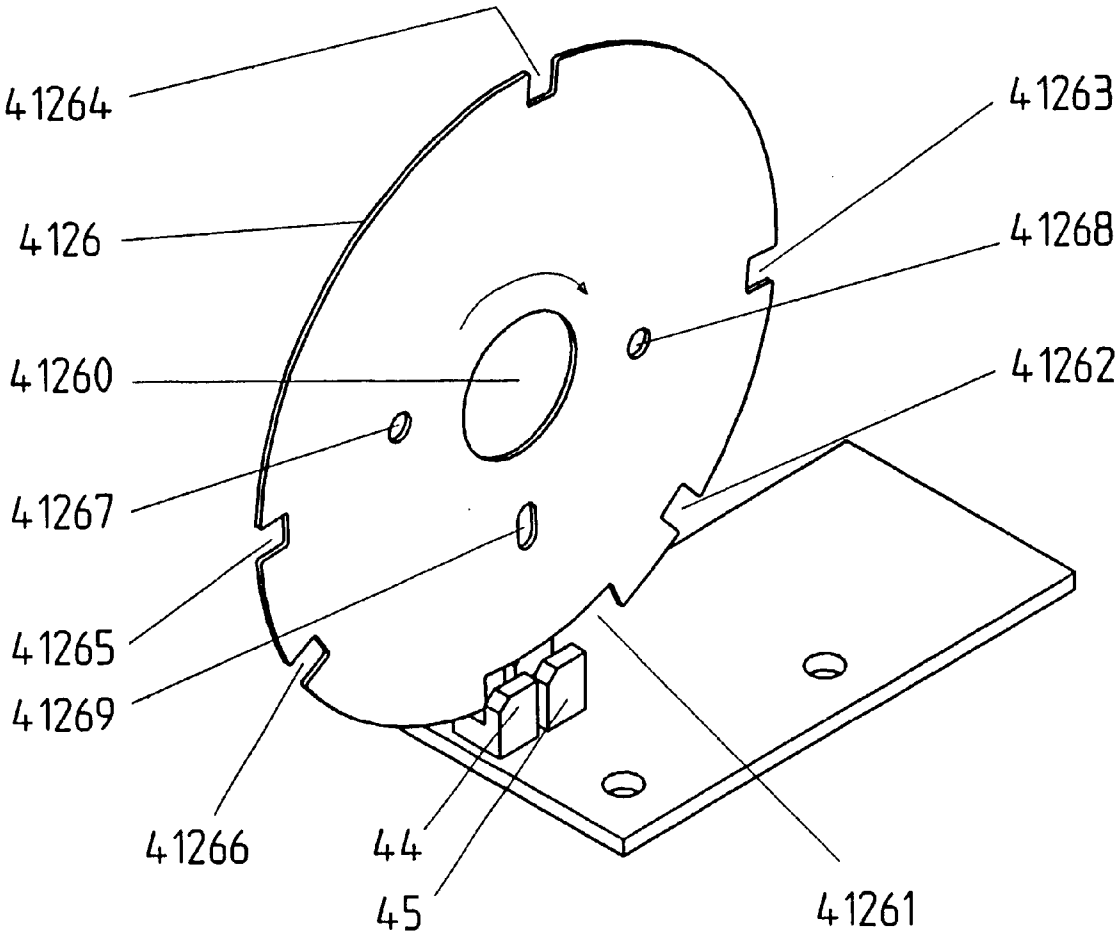
FIG. 10 is a perspective view showing details of the slotted disk along with scanning.

The following associations exist in the clockwise direction following the blocking circle, with reference also being made to the discussion of FIG. 10:

the first slots 41221, 41231 of the cam disks 4122, 4123 and the first set of teeth 41241 of the toothed quadrant wheel 4124 mesh with the first and second pinions 4131, 4132 of the double-jointed connection 42 with the IPH 2 in order to achieve the "printing position";

the second slots 41222, 41232 of the cam disks 4122, 4123 and the second set of teeth 41242 of the toothed quadrant wheel 4124 mesh with the first and second pinions 4131, 4132 of the double-jointed connection 42 with the IPH 2 in order to achieve the "second position of repose";

the first slots 41221, 41231 of the cam disks 4122, 4123 and the first set of teeth 41241 of the toothed quadrant wheel 4124 mesh with the first and second pinions 4141, 4142 of the double-jointed connection 43 with the CSD 3 in order to achieve the "sealing position"; and the second slots 41222, 41232 of the cam disks 4122, 4123 and the second set of teeth 41242 of the toothed quadrant wheel 4124 mesh with the first and second pinions 4141, 4142 of the double-jointed connection 43 with the CSD 3 in order to achieve the "first position of repose".

The first pinions 4131, 4141 have uniform toothing including four undercut teeth 41311, 41411 and are thinner than the associated first cam disk 4122. The slots 41221, 41222 of the cam disk 4122 are dimensioned in such a way that two teeth 41311, 41411 at a time can plunge into them simultaneously.

The second pinions 4132, 4142 are dimensioned to be thick enough that nearly the total dimension including both the thickness of the second cam disk 4123 and the thickness of the toothed quadrant wheel 4124 is attained.

The portions of the second pinions 4132, 4142 that mesh with the second cam disk 4123 have two diametrically opposed tooth gaps 41322, 41422, with otherwise uniform toothing. In other words, at these points, the tooth thickness is reduced by the thickness of the second cam disk 4122.

In the second cam disk 4123, the slots 41231, 41232 are dimensioned in such a way that two teeth 41321, 41421 at a time can plunge in simultaneously.

In the regions associated with the slots 41231, 41232, the toothed quadrant wheel 4124 is provided with the toothing 41241, 41242 that is equivalent to half a revolution of the pinion 4132, 4142.

According to FIG. 10, the slotted disk 4126 is provided with six slots 41261 through 41266 on an outer edge, corresponding to the number of intended positions or combination positions of the IPH 2 and the CSD 3. The kinematic conversion of all of the positions and the attendant functions is distributed over one full revolution of the slotted disk 4126.

The functional association with the various slots 41261 through 41266 will now be explained.

The "sealing position" is associated with the first slot 41261. In this position, the IPH 2 is pivoted with its nozzle surface 2101 parallel to the front side of the sealing cap 31, and the sealing cap is docked at the IPH 2. Reference is also made to FIGS. 5 and 6 in this regard. In this case the wiper lip 32 has moved into a lateral maintenance position.

The "wiping position" is associated with the second slot 41262. In this position, the sealing cap 31 has moved downward so far that the wiper lip 32 with its doctor blade insert 322 can slide unhindered over the nozzle surface 2101.

The "first position of repose" is associated with the third slot 41263. In this position, the sealing cap 31 has moved downward as far as its bottom dead center position, and the IPH 2 is disposed with its nozzle surface 2101 still unchanged, parallel to the front side of the sealing cap 31.

The "printing position" is associated with the fourth slot 41264. In this position, the IPH 2 is disposed with its nozzle surface 2101 parallel to the guide plate 1. The sealing cap 31 is still down as far as bottom dead center, as is also seen in FIG. 1.

The "second position of repose" is associated with the fifth slot 41265. In this position, the IPH 2 is pivoted out of the "printing position" into the parallel position with regard to the CSD 3, or to the front side of the sealing cap 31, which is still at bottom dead center.

The "readiness position" is associated with the sixth slot 41266. In this position, the IPH 2 assumes the parallel position to the front side of the sealing cap 31, and the latter is driven upward at an accelerated pace from bottom dead center to a position that is slightly below the "wiping position".

The slot 41261 for the "sealing position" is so wide that both parallel photosensors 44, 45 can be tripped simultaneously. The other slots 41262 through 41266 are only wide enough to allow one photosensor at a time to be tripped.

FIG. 11 shows the interplay between the valve 36 for ventilating the sealing cap 31 or the rubber-elastic flanges 3101 for vacuuming or suctioning off the rows of nozzles 211, and the first crank 431 of the double-joint connection 43. Reference is also made to FIG. 7 in this regard.

The valve 36 is secured to the frame 8 in such a way that one flank or side of the crank 431, as it slides past, covers or closes a slightly protruding rubber-elastic opening 361 of the valve 36 in a force-locking manner.

In addition to the criterion of the disposition of the valve opening 361 in the path of motion of the flank or side of the crank 431, the fastening point is selected in such a way that while the valve 36 is indeed closed in the "sealing position", it is opened again even before leaving that position.

We claim:

1. An apparatus for printing on print media comprising:

a guide plate with a printing window;

an ink jet print head disposed stationarily behind said guide plate in said printing window when in a printing position;

a cleaning and sealing device behind said guide plate;

a transport device guiding print media resting on said guide plate;

a common gear pivoting said ink jet print head out of said printing position, into a non-printing position and back again, and said common gear adjusting said cleaning and sealing device behind said guide plate toward and away from said ink jet print head, said non-printing position chosen from the group consisting of a cleaning position and a sealing position; and a motor running in only one direction of rotation for driving said common gear to adjust said ink jet print head and said cleaning and sealing device.

2. The device according to claim 1, including a common frame, the ink jet print head, the cleaning and sealing device, said common gear and said motor secured in said common frame and combined into a compact structural group adjustably secured to the transport device.

3. The device according to claim 1, wherein the apparatus is at least one of a postage meter and an addressing machine.

4. The device according to claim 2, wherein:

the guide plate is inclined past the vertical;

the ink jet print head is pivotable by more than 90° out of the printing position, into the cleaning position and back again; and the cleaning and sealing device is disposed in a linearly height-adjustable manner below the ink jet print head.

5. The device according to claim 4, including:

a shaft rotatably supported in said frame, the ink jet print head secured to said shaft; and a carrier for the transport device, said frame pivotably secured within an adjusting range on said carrier.

6. The device according to claim 5, including:

a rigid support shaft and a rotationally movable, resiliently adjustable adjusting element disposed on said frame;

said support shaft and said adjusting element connecting said frame to said carrier;

said support shaft thrust into a bore in said carrier and resiliently locked; and said adjusting element rotatable about said support shaft within a tolerance range.

7. The device according to claim 5, wherein:

the cleaning and sealing device includes a sealing cap, a wiper lip, a suction pump, a waste ink tank, a frame for fastening to said common frame, and two vertically disposed columns secured in said frame; and said sealing cap, said wiper lip and said suction pump are guided adjustably in height between said two vertically disposed columns.

8. The device according to claim 7, including an adjustable stop, the ink jet print head supported rotatably and resiliently against said adjustable stop; and said sealing cap supported resiliently and floatingly.

9. The device according to claim 7, including guide shafts secured to the outside of and parallel to said sealing cap, said wiper lip linearly adjustably supported on said guide shafts.

10. The device according to claim 9, wherein said wiper lip has a housing, and a spindle drive for adjusting said wiper lip includes:

a threaded bush inserted into said wiper lip housing;

a motor;

a spur gear driven by said motor; and a threaded rod rotatably secured to said sealing cap adjacent and parallel to one of said guide shafts, said threaded rod having one side coupled to said spur gear and another side on which said threaded bush is seated.

11. The device according to claim 4, wherein said gear for adjusting the ink jet print head and the cleaning and sealing device is constructed substantially as a Maltese cross gear including:

a spur gear coupled directly to said motor;

one double-jointed connection from said spur gear to the ink jet print head;

another double-jointed connection from said spur gear to the cleaning and sealing device;

an evaluation and control circuit;

two photosensors connected to said evaluation and control circuit; and a slotted disk coupled with said gear for scanning said two photosensors.

12. The device according to claim 11, wherein:

said motor has a shaft with an extension;

said double-jointed connections have first cranks; and said spur gear includes:

a worm seated on said extension;

first and second shafts;

a worm wheel and a small gear wheel jointly seated on said first shaft, with said worm wheel meshing with said worm;

a large gear wheel seated on said second shaft and meshing with said small gear wheel;

first and second cam disks having the same profile and a slightly different diameter, and a toothed quadrant wheel having the same outer diameter as said second cam disk and aligned with said first and second cam disks on said second shaft downstream of said large gear wheel;

a flange disk for said slotted disk, said flange disk and said slotted disk seated on said second shaft;

third and fourth shafts;

one first and one second pinion and said first crank of said one double-jointed connection to the ink jet print head jointly seated on said third shaft, said first pinion meshing with said first cam disk, and said second pinion meshing with said second cam disk and said toothed quadrant wheel, in a play-free connection; and another first and another second pinion and said first crank of said other double-jointed connection to the cleaning and sealing device jointly seated on said fourth shaft, said first pinion meshing with said first cam disk, and said second pinion meshing with said second cam disk and said toothed quadrant wheel, in a play-free connection.

13. The device according to claim 12, wherein said one double-jointed connection of said spur gear to the ink jet print head includes said first crank having one end rigidly joined to said third shaft and another end, a first articulated shaft rotationally movably joined to said other end of said first crank, a rod having one end rotationally movably seated on said first articulated shaft and another end, a second articulated shaft rotationally movably connected to said other end of said rod, and a second crank having one end rigidly connected to said second articulated shaft.

14. The device according to claim 12, wherein said other double-jointed connection of said spur gear to the cleaning and sealing device includes said first crank having one end rigidly joined to said fourth shaft and another end, a first articulated shaft rotationally movably joined to said other end of said first crank, a rod having one end rotationally movably seated on said first articulated shaft and another end, a second articulated shaft rotationally movably connected to said other end of said rod, and a second crank having one end rigidly connected to said second articulated shaft.

15. The device according to claim 13, including:

another shaft rotatably supported in said frame, the ink jet print head secured to said other shaft; p1 said second crank having another end rotationally movably secured to said other shaft and having a fixed stop and an adjustable stop;

the ink jet print head resiliently pivotable between said stops, the ink jet print head resting force-lockingly on said adjustable stop; and said stops having a spacing defining the play for the ink jet print head.

16. The device according to claim 15, including a spiral spring thrust onto said other shaft and having one end catching on said frame and another end catching on a housing of the ink jet print head; and said adjustable stop being an adjusting screw guided in a threaded hole in said second crank.

17. The device according to claim 14, wherein:

the cleaning and sealing device includes a sealing cap, a wiper lip, a suction pump, a waste ink tank, a frame for fastening to said common frame, and two vertically disposed columns secured in said frame;

said sealing cap, said wiper lip and said suction pump are guided adjustably in height between said two vertically disposed columns; and said second crank is a sled to be displaced under compulsory guidance on said columns.

18. The device according to claim 11, wherein said double- jointed connections are coupled diametrically opposite one another to said spur gear.

19. The device according to claim 12, wherein:

said slotted disk has an outer periphery with slots corresponding to a number of positions or position combinations of the ink jet print head and the cleaning and sealing device; and a kinematic conversion of all of said positions and attendant functions is distributed over one full revolution of said slotted disk.

20. The device according to claim 19, wherein:

the ink jet print head has a nozzle surface;

the cleaning and sealing device includes a sealing cap with a front side, a wiper lip, a suction pump, a waste ink tank, a frame for fastening to said common frame, and two vertically disposed columns secured in said frame;

said sealing cap, said wiper lip and said suction pump are guided adjustably in height between said two vertically disposed columns; and said slots are first through sixth slots and said positions include:

a sealing position associated with said first slot, in said sealing position the ink jet print head is pivoted with the nozzle surface parallel to said front side of said sealing cap, said sealing cap is docked at the ink jet print head, and said wiper lip has moved into a lateral maintenance position;

a wiping position associated with said second slot, in said wiping position said sealing cap has moved downward so far that said wiper lip can slide unhindered over the nozzle surface;

a first position of repose associated with said third slot, in said first position of repose said sealing cap has moved downward as far as its bottom dead center position, and the ink jet print head is disposed with its nozzle surface still unchanged, parallel to said front side of said sealing cap;

a printing position associated with said fourth slot, in said printing position the ink jet print head is disposed with its nozzle surface parallel to the guide plate, and said sealing cap is still down as far as bottom dead center;

a second position of repose associated with said fifth slot, in said second position of repose the ink jet print head is pivoted out of said printing position into said position of repose, and said sealing cap is still disposed at bottom dead center; and a readiness position associated with said sixth slot, in said readiness position the ink jet print head assumes said position of repose and said sealing cap, arriving at an accelerated pace from bottom dead center, comes to rest slightly below said wiping position.

21. The device according to claim 20, wherein said first slot for said sealing position is wide enough to trip both parallel photosensors simultaneously, and said second through sixth slots are only wide enough to trip one photosensor at a time.

22. The device according to claim 20, wherein:

said large gear wheel has uniform toothing throughout;

said two cam disks have an outer periphery each with first and second slots inside a semicircle and a remainder constructed as a blocking circle;

said toothed quadrant wheel includes regions associated with said slots having first and second sets of teeth with roots at a given depth, and a remainder cut out smoothly in a round circle to said given depth; and in clockwise direction following said blocking circle:

said first slot of said cam disks and said first set of teeth of said toothed quadrant wheel mesh with said first and second pinions of said one double-jointed connection with the ink jet print head to achieve said printing position;

said second slot of said cam disks and said second set of teeth of said toothed quadrant wheel mesh with said first and second pinions of said one double-jointed connection with the ink jet print head to achieve said second position of repose;

said first slot of said cam disks and said first set of teeth of said toothed quadrant wheel mesh with said first and second pinions of said other double-jointed connection with the cleaning and sealing device to achieve said sealing position; and said second slot of said cam disks and said second set of teeth of said toothed quadrant wheel mesh with said first and second pinions of said other double-jointed connection with the cleaning and sealing device to achieve said first position of repose.

23. The device according to claim 22, wherein:

said first pinion has uniform toothing including four undercut teeth and is narrower than said associated first cam disk, and said slots of said cam disk are dimensioned to permit two teeth at a time to plunge into them simultaneously;

said second pinion is dimensioned thick enough to attain nearly a total dimension including both a thickness of said second cam disk and a thickness of said toothed quadrant wheel;

a portion of said second pinion meshing with said second cam disk has two diametrically opposed tooth gaps, with otherwise uniform toothing, and said slots in said second cam disk are dimensioned to permit two teeth at a time to plunge into them simultaneously; and said toothed quadrant wheel has regions associated with said slots with toothing equivalent to half a revolution of said second pinion.

24. The device according to claim 7, wherein:

the ink jet print head has nozzle rows;

said sealing cap has rubber-elastic flanges for vacuuming the nozzle rows, ventilation holes in said flanges, and a hose connection from said ventilation holes; and valve is connected to said hose connection.

25. The device according to claim 20, wherein:

the cleaning and sealing device includes a sealing cap, a wiper lip, a suction pump, a waste ink tank, a frame for fastening to said common frame, and two vertically disposed columns secured in said frame, and said sealing cap, said wiper lip and said suction pump are guided adjustably in height between said two vertically disposed columns;

the ink jet print head has nozzle rows, said sealing cap has rubber-elastic flanges for vacuuming the nozzle rows, ventilation holes in said flanges, and a hose connection from said ventilation holes, and a valve is connected to said hose connection;

said other double-jointed connection of said spur gear to the cleaning and sealing device includes said first crank having sides, one end rigidly joined to said fourth shaft and another end, a first articulated shaft rotationally movably joined to said other end of said first crank, a rod having one end rotationally movably seated on said first articulated shaft and another end, a second articulated shaft rotationally movably connected to said other end of said rod, and a second crank having one end rigidly connected to said second articulated shaft; and said valve has a slightly protruding rubber-elastic opening and is disposed in a path of motion of one of said sides of said first crank of said other double-joint connection of said gear to the cleaning and sealing device for closing said rubber-elastic opening with said side in said sealing position but opening said rubber-elastic opening again before leaving said sealing position.

26. The device according to claim 25, wherein said valve is secured to said common frame.

* * * * *